United States Patent [19]

Torstenfelt

[11] 4,149,826

[45] Apr. 17, 1979

[54] GAS TURBINE

[75] Inventor: Nils A. R. Torstenfelt, Finspong, Sweden

[73] Assignee: Stal-Labal Turbin AB, Finspong, Sweden

[21] Appl. No.: 810,339

[22] Filed: Jun. 27, 1977

[30] Foreign Application Priority Data

Jul. 5, 1976 [SE] Sweden ..... 7607667

[51] Int. Cl.[2] ..... F01D 25/24

[52] U.S. Cl. ..... 415/127; 415/131; 60/39.32

[58] Field of Search ..... 415/126, 127, 131, 132, 415/48, 140, 134; 60/39.31, 39.32

[56] References Cited

U.S. PATENT DOCUMENTS 2,762,559 9/1956 Faught ..... 415/48 X 3,837,164 9/1974 Carr ..... 60/39.31 X 3,908,361 9/1975 Gardiner ..... 60/39.32

FOREIGN PATENT DOCUMENTS 668434 3/1952 United Kingdom ..... 415/126

*Primary Examiner*—Carlton R. Croyle

*Assistant Examiner*—Donald S. Holland

*Attorney, Agent, or Firm*—Pollock, Vande Sande & Priddy

[57] ABSTRACT

A gas turbine having a rotor and a stator, the stator defining a blade channel which is of generally conical configuration and being axially movable relative to the rotor. A thermal responsive means which is heated in accordance with the temperature of the gas in the turbine moves the stator and rotor axially relative to each other to vary the gap therebetween so as to maintain the clearance between the rotor blades and the stator housing within predetermined values. The gap is subject also to the rotational forces acting on the rotor blades.

6 Claims, 1 Drawing Figure

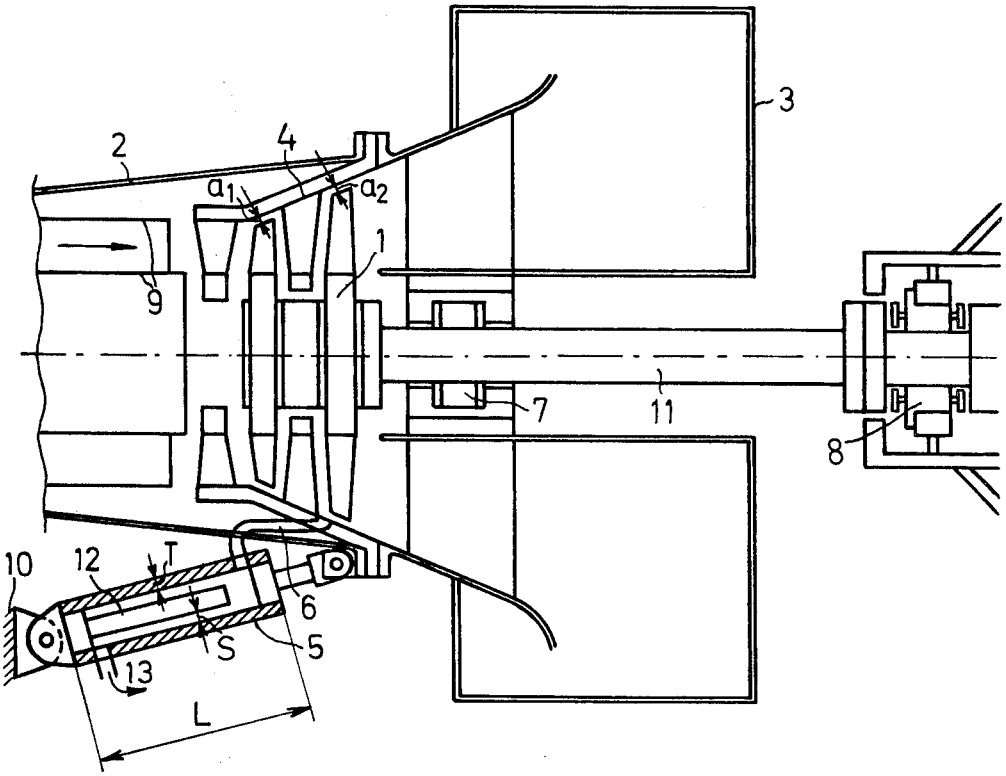
3
2
4
$a_1$
$a_2$
1
9
7
11
8
10
12
T
6
5
S
13
L

GAS TURBINE

BACKGROUND OF THE INVENTION

The present invention relates to a gas turbine which includes a means to vary the gap between the stator and the rotor automatically in accordance with the temperature of the gas in the turbine. In a gas turbine, as in all other turbines and turbo-machines, it is desirable to maintain the play between the inner side of the stator housing and the top of the rotor blades as small as possible to obtain a blade system which is as tight as possible and therefore results in the smallest possible leakage of the active medium. In this connection, however, due regard must be paid to thermal changes in the system, which are great particularly in the case of gas turbines, and also to changes caused by rotational forces. The variation of the gap at the blade tip with time during a starting operation is normally such that the smallest gap occurs at a certain time, for example about 10 minutes, after a start, and then again increases because of different heating times for the stator and the rotor. To avoid seizure, the start gap must therefore be sufficiently large, which then results in the gap becoming undesirably large at the full load.

SUMMARY OF THE INVENTION

Restoring the operating gap to the desired value may be achieved according to the present invention by making the stator and rotor mutually axially movable. Thus the rotor and stator are provided with conically shaped portions which are axially movable relative to each other and a thermally responsive member is provided which responds to the turbine gas temperature to move the rotor and stator axially relative to each other to provide a gap therebetween which is maintained within predetermined limits.

BRIEF DESCRIPTION OF THE DRAWINGS

In describing the invention, reference will be made to the accompanying drawing which shows a section through a gas turbine constructed according to the invention.

DETAILED DESCRIPTION OF THE PREFERRED EMBODIMENT

The shaft 11 of the turbine rotor 1 is journalled in a pure radial bearing 7 and also a combined axial-radial bearing 8 which is fixed to the machine bed. The combined bearing 8 may, for example, be supported in an electric generator driven by the turbine.

The stator 4 is connected to the gas generator (not shown) of the turbine by means of casing 2, inside which there are arranged inner, coaxial, cylindrical thermal shields 9. At the other end of the stator there is arranged an outlet housing 3 for the exhaust gases.

The stationary part, that is the casing 2, the stator 4 and the outlet housing 3, is supported in a manner to permit it to be movable axially in relation to the rotor 1. Such movement may be effected, for example, by pivotally arranged links or columns. More particularly, the axial position of the stator is determined by the stay 5 which may be in the form of a tube, one end of which is connected to a suitable part of the stator 4 by way of tube 6, whereas the other end is attached to the bed at point 10. Said other end may be provided with an outlet 13 which leads, for example, to a chimney. In this way, the stay is traversed by part of the hot gases from the turbine.

The above arrangement makes it possible to maintain large gaps $a_1$ and $a_2$ between rotor blades and stator housing upon starting, but still maintain a small gap at full load.

When applying a load, the stator and rotor are moved relative to each other so that the gaps $a_1$ and $a_2$ are reduced. At the same time, the stay 5 is heated. The heating of the rotor blades and also the rotational forces acting on the blades both act to reduce these gaps. On the other hand, the thermal expansion of the stator housing tends to increase the gap.

The axial range of movement of the stator is determined by the choice of the length L of the stay 5 and the choice of the material of which the stay is made to provide appropriate thermal expansion. The thermal inertia of the stay may be determined by the choice of the wall thickness T of the stay, and the heat transfer ratio may be determined by the choice of the gap S between the inner side of the stay and cylinder 12 within the stay. The tube 6 may be provided with a regulating valve or a throttle plate.

In constructing apparatus according to the invention, one must determine the movements and thermal expansion of the stator and the rotor in relation to load, temperature and time, so that the variations in the gaps $a_1$, $a_2$ are known. Thereafter, the dimensions of the stay 5 may be determined based on the predetermined gaps desired at standstill and at full load so that the desired freedom between the stator and the rotor is achieved upon starting and stopping while, at the same time, the desired tightness is achieved at full load.

What I claim is:

1. In a gas turbine having a rotor and a stator defining therebetween a conical blade channel of increasing diameter in the direction of gas flow, the improvement comprising:

means permitting relative axial movement between said rotor and said stator, and means responsive to the temperature of the gases in the turbine and the forces acting on the rotor blades to vary the gap between the tips of the rotor blades and the stator housing so as to maintain the gap within predetermined limits, said responsive means including a stay which is subjected to the temperature of the gas in the turbine, the length of said stay varying in accordance with the gas temperature.

2. The gas turbine of claim 1 in which said rotor is fixed in axial position and said stator is supported to permit axial movement.

3. The gas turbine of claim 1 which includes gas flow means for causing a portion of the turbine gases to flow over said stay to vary its length.

4. The gas turbine of claim 3 in which said stay is hollow and said gas flow means causes said portion of the turbine gases to flow through the hollow part of said stay.

5. The gas turbine of claim 4 in which the wall thickness of said stay and the cross-sectional flow area of the turbine gases through the hollow portion of said stay are selected to provide a predetermined relationship between the temperature of the turbine gases and extent of elongation of said stay.

6. In a gas turbine having a rotor and a stator defining therebetween a conical blade channel of increasing diameter in the direction of gas flow, the improvement comprising:

means permitting relative axial movement between said rotor and said stator, and means responsive to the temperature of the gases in the turbine and the forces acting on the rotor blades to vary the gap between the tips of the rotor blades and the stator housing so as to maintain the gas within predetermined limits, said responsive means including a stay connected to a casing portion, said stay being subjected to the temperature of the gas in the turbine, whereby the length of said stay varies in accordance with the gas temperature.

* * * * *